United States Patent [19]

Bhalla

[11] 4,210,840

[45] Jul. 1, 1980

[54] HID LAMP EMISSION MATERIAL

[75] Inventor: Ranbir S. Bhalla, Montville Township, Morris County, N.J.

[73] Assignee: Westinghouse Electric Corp., Pittsburgh, Pa.

[21] Appl. No.: 968,709

[22] Filed: Dec. 12, 1978

[51] Int. Cl.[2] ..... H01J 1/14; H01J 61/073

[52] U.S. Cl. ..... 313/218; 313/211; 313/346 R

[58] Field of Search ..... 313/218, 213, 346 R, 313/211

[56] References Cited

U.S. PATENT DOCUMENTS

| | | | |
|---|---|---|---|
| 2,687,489 | 8/1954 | Anderson, Jr. et al. | 313/211 |
| 2,806,970 | 9/1957 | Meister et al. | 313/346 R X |
| 3,249,788 | 5/1966 | Wainio et al. | 313/213 X |
| 3,523,915 | 8/1970 | Anthony et al. | 313/218 X |
| 3,708,710 | 1/1973 | Smyser et al. | 313/213 |
| 4,052,634 | 10/1977 | De Kok | 313/218 X |
| 4,123,685 | 10/1978 | Bhalla | 313/218 |
| 4,152,619 | 5/1979 | Bhalla | 313/218 |

*Primary Examiner*—Palmer C. Demeo

*Attorney, Agent, or Firm*—B. R. Studebaker

[57] ABSTRACT

An improved composite emission material for use in the electrodes of high intensity (HID) lamps comprising a reacted mixture of barium zirconate and strontium zirconate wherein the ratio of barium to strontium is from between 9:1 to 1:1 and is preferably 4:1. The improved emission material has a lower vapor pressure, higher melting point and a reduced processing time as compared to prior art emission materials.

8 Claims, 3 Drawing Figures

HID LAMP EMISSION MATERIAL

BACKGROUND OF THE INVENTION

This invention relates to high intensity discharge (HID) lamps and, more particularly, to improved electron emissive material for the electrodes of such lamps.

High pressure sodium-mercury vapor lamps have in the past used as an electron emissive material a mixture of several oxide phases comprising thorium dioxide, barium thoriate, dibarium calcium tungstate and barium oxide, hereinafter referred to as a "mixed oxide" emission material. This mixture of oxide phases was quite sensitive to the atmospheric contaminants with the result that even a brief exposure to air resulted in a relatively large pick up of water and carbon dioxide by the emissive mixture. Such contaminates were rather difficult to remove.

More recently, as disclosed in U.S. Pat. No. 3,708,710, dated Jan. 2, 1973, a high intensity discharge sodium-mercury vapor lamp which utilizes dibarium calcium tungstate as an electron emissive material, particularly effective in sodium vapor lamps employing polycrystalline aluminum arc tube bodies has been disclosed. Similarly, U.S. Pat. No. 4,052,634, dated Oct. 4, 1977, discloses an emission material for high pressure mercury vapor and high pressure sodium vapor discharge lamps which consist mainly of one or more oxide compounds containing at least one of the rare earth metal oxides, alkaline earth metal oxide and at least one of the oxides of tungsten and molybdenum in a quantity of 0.25 to 0.40 mole per mole of alkaline earth metal oxide, the alkaline earth metal oxide consisting of at least 25 mole percent of barium oxide.

Efforts have continued in the development of emissive materials for HID lamps in an effort to remove the radioactive thorium oxide present in the "mixed oxide" electrode and in most instances the resulting emissive materials have included barium because it is highly refractive and a good emissive material. In this connection, more recently, U.S. Pat. No. 4,123,685, issued Oct. 31, 1978, discloses an electron emissive material consisting essentially of a solid solution of dibarium calcium tungstate and dibarium calcium molybdate wherein the molar ratio of tungstate to molybdate falls within the range of from 9:1 to 1:9. Also, an electron emissive material consisting essentially of $M_3$, $M'_2$, $M''O_9$, wherein: M is alkaline-earth metal and at least principally comprises barium; M' is yttrium, a lanthanoid series metal or any mixtures thereof; and M'' is tungsten molybdenum or mixtures thereof has been disclosed in U.S. patent application Ser. No. 845,521, filed Oct. 26, 1977, now issued as U.S. Pat. No. 4,152,619, dated May 1, 1979, issued to the present inventor and owned by the present assignee. Each of these latter electron emissive materials perform well in high pressure mercury and sodium-mercury HID lamps. Each requires a three-step heating cycle to prepare the material for use as an electron emissive material.

SUMMARY OF THE INVENTION

In accordance with the present invention, an electron emissive material is provided for use in high intensity discharge (HID) lamps which comprises a reacted mixture of barium zirconate ($BaZrO_3$) and strontium zirconate ($SrZrO_3$), wherein the ratio of barium to strontium is from between 9:1 to 1:1 and is preferably about 4:1. This improved emission material has a lower vapor pressure, higher melting point and a reduced processing time as compared to prior art emission materials. The high intensity discharge lamp generally comprises a radiation-transmitting arc tube having electrodes operatively supported therein proximate the ends thereof which are adapted to have an elongated arc discharge maintained therebetween and means for connecting the electrodes to an energizing power source. Each of the electrodes, in accordance with this invention, are provided with an emission material disposed within the coil structure of the electrode which comprises a reacted mixture of barium zirconate ($BaZrO_3$) and strontium zirconate ($SrZrO_3$) with each being present in a ratio of 9:1 to 1:1 and preferably present in a ratio of about 4:1.

BRIEF DESCRIPTION OF THE DRAWINGS

Many of the attendant advantages of the present invention will become more readily apparent and better understood as the following detailed description is considered in connection with the accompanying drawings in which.

DESCRIPTION OF THE PREFERRED EMBODIMENT

Figure 1:
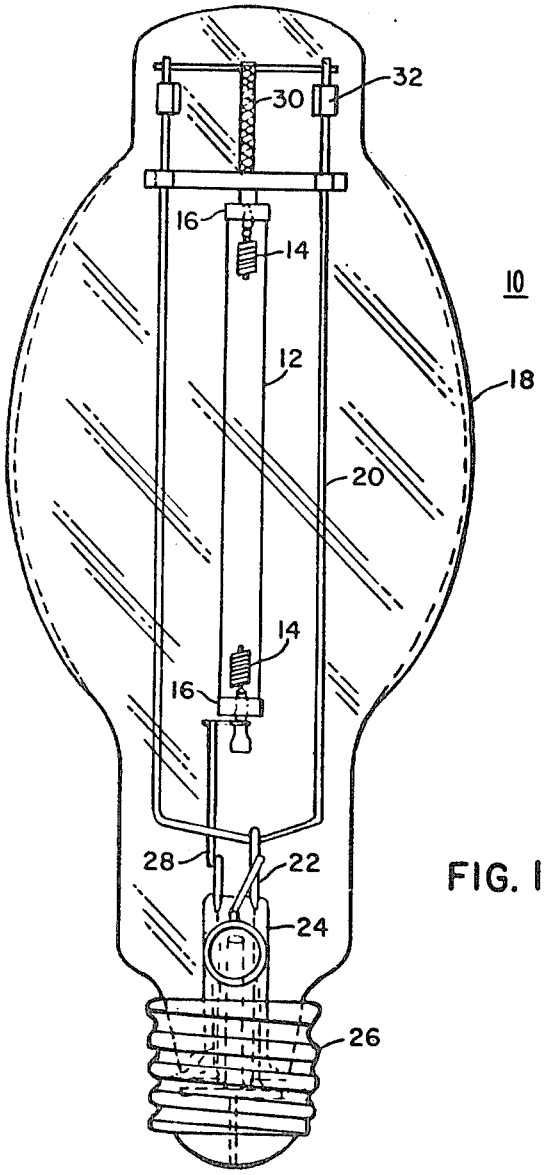
FIG. 1 is a side elevational view of a typical HID sodium-mercury lamp which incorporates the present improved electrodes.

Referring now in detail to the drawings wherein like reference characters represent like parts throughout several views, there is illustrated in FIG. 1 a typical HID sodium-mercury lamp 10 comprising a radiation transmitting arc tube 12 having electrodes 14 operatively supported therein proximate the ends thereof and adapted to have an elongated arc discharged maintained therebetween. The arc tube is fabricated of refractory materials such as single crystal or polycrystalline alumina having niobium end caps 16 sealed to the ends thereof. The arc tube 12 is suitably supported within a protective outer envelope 18 by means of a supporting frame 20 which is connected to one lead-in conductor 22 sealed through a conventional stem press arrangement 24 for connection to the conventional lamp base 26. The other lead-in conductor 28 connects to the other lamp electrode 14. Electrical connection to the uppermost electrode 14 is made through the frame 20 and a resilient braided connector 30 to facilitate expansion and contraction of the arc tube 12. The frame 20 is maintained in position within the bulb by suitable metallic spring spacing members 32 which contact the inner surface of the dome portion of the protective envelope 18. As a discharge sustaining filling the arc tube contains a small controlled charge of sodium-mercury amalgam and a low pressure of inert ionizable starting gas such as 20 torrs of xenon.

Figure 2:
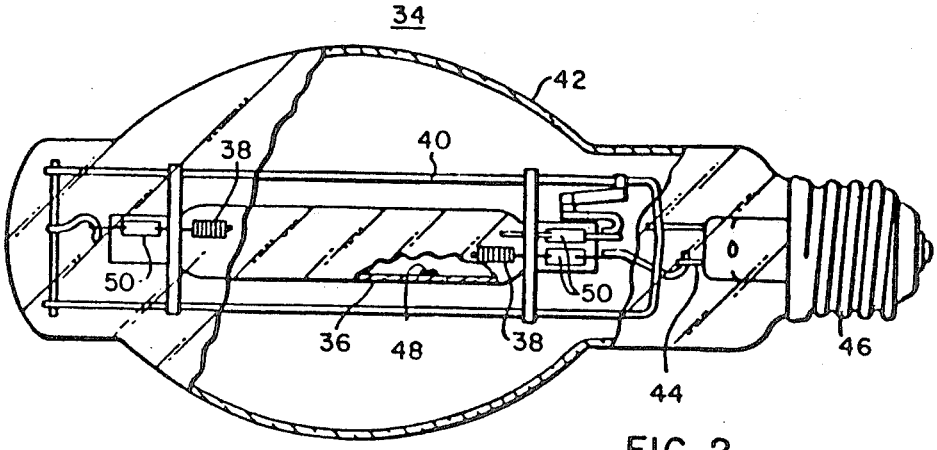
FIG. 2 is an elevational view of an HID mercury-vapor lamp which incorporates the present electrodes.
Figure 3:
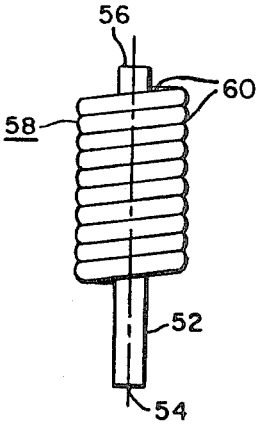
FIG. 3 is an enlarged view of a discharge sustaining electrode having the emission material of this invention disposed therein.

The high pressure mercury vapor lamp 34, as shown in FIG. 2, is also generally conventional and comprises a light transmitting arc tube 36 which is usually fabricated of quartz having the operating electrodes 38 operatively supported therein proximate the ends thereof and adapted to have an elongated arc discharge maintained therebetween. The conventional supporting frame 40 serves to suitably support the arc tube within the protective outer envelope 42 and to provide electrical connection to electrode 38 remote from the base 46. The other electrode 38 is connected directly to one of the lead-in conductors 44 and thence to the base 46 so that the combination provides means for connecting the lamp electrodes 38 to an energizing power source. As is conventional, the lamp contains a small charge of mercury 48 which together with an inert ionizable starting gas comprises a radiation sustaining filling. In this lamp embodiment, ribbon seals 50 provided at the ends of the arc tube 36 facilitates sealing the lead-in conductors therethrough in order to connect to the electrodes 38. FIG. 3 illustrates a typical electrode suitable for use in either of the lamps of FIGS. 1 and 2. The electrode comprises an elongated refractory metal member 52 having one end portion thereof 54 which is adapted to be supported proximate the end of the lamp arc tube with the other end portion 56 of the metal member adapted to project a short distance inwardly within the arc tube. An overfitting refractory metal coil means 58 is carried on the elongated metal member 52 proximate the end 56 thereof. As a specific example, the elongated metal member is formed as a tungsten rod having a diameter of approximately 0.032 inch (0.8 milimeters) and the overfitting coil 58 as shown in FIG. 3, comprises 8 turns of tungsten wire which has a diameter of 0.016 inch (0.4 mm.). The outer diameter of the coil 58 can vary from 0.09 inch (2.29 mm.) to 0.11 inch (2.8 mm.). The electron emissive material 60 of this invention is disposed in the spaces between the coils 58 and also between the interior rod 56 and the coils 58.

Barium, as evidenced from the prior art is an excellent non-radioactive emission material for use in high pressure discharge lamp electrodes. It has been found that barium zirconate ($BaZrO_3$) is equivalent to the so-called "mixed oxide" electrode or electrodes with $Ba_2CaWO_6$ as the emission material in emission properties and has a very high melting point at about 2688° C. By combining strontium zirconate ($SrZrO_3$) with its melting point of 2800° C. with the barium zirconate an emission material is produced which is one of the most refractory emission materials known.

In preparing the emission material of this invention, preferably, 8 moles of barium carbonate, 2 moles of strontium carbonate and 10 moles of zirconium oxide are ball milled for 48 hours to provide complete dispersion. The resulting powder is then fired at 1500° C. for 4 hours in air to drive off the carbon dioxide and provide a reacted mixture of barium zirconate ($BaZrO_3$) and strontium zirconate ($SrZrO_3$) with a ratio of barium zirconate to strontium zirconate of 4:1. The resultant reacted mixture is then mixed in amyal acetate to a paste-like consistency and then vacuum deposited on the coil illustrated in FIG. 3 in the conventional manner. The coils are then rolled in tungsten chunks to remove excess emission material from the outer surface of the electrode. It has been found that the emission material of this invention has a lower vapor pressure than the prior art materials as well as an increased melting point. Additionally, the reduced process time of only 4 hours at a single temperature setting as opposed to the 3 different firings of 2 hours each at different firing temperatures required of the better prior art emission materials provides for a lower processing time for the materials.

It has also been found that the emission material of this invention may be provided with a barium zirconate to strontium zirconate ratio of from between 9:1 to 1:1 and still provide satisfactory emission material for a high intensity discharge lamp. Preferably, a ratio of barium zirconate to strontium zirconate is 4:1.

Four hundred watt mercury lamps having clear outer envelopes were tested with a "mixed oxide" electrode in one, a tribarium diyttrium tungstate emission material in another and the barium strontium zirconate emission material in a third. Tests on these lamps are illustrated in Example I and show a distinct improvement in lumen maintenance at 2,000 hours as compared to 100 hours for the barium strontium zirconate emission material of this invention.

EXAMPLE I

| Emission Material | Lumens at 100 Hours | 1,000 Hours | 2,000 Hours | % Maintenance |
|---|---|---|---|---|
| "mixed oxide" | 20760 | 18820 | 18640 | 89.8 |
| $Ba_3Y_2WO_9$ | 20520 | 19460 | 18830 | 91.8 |
| (BaSr) $ZrO_3$ | 20630 | 20040 | 19970 | 96.8 |

In a second test, a pair of 400 watt mercury lamps having a vanadate phosphor coating on the outer envelope were prepared, one utilizing the "mixed oxide" emission material and the other utilizing barium zirconate strontium zirconate in ratio of 4:1 as the emission material. Example II below illustrates again the superior lumen maintenance of the barium strontium zirconate emission material of this invention.

EXAMPLE II

| Emission Material | 100 Hours | 2,500 Hours | % Maintenance |
|---|---|---|---|
| (BaSr) $ZrO_3$ | 22350 | 19970 | 89.4 |
| "Mixed Oxide" | 22310 | 18810 | 84.3 |

The reacted mixture of barium zirconate and strontium zirconate of this invention provides an emission material for HID lamps which is highly refractory, evidences good maintenance during lamp life and is a material with a high melting temperature as well as having good emissive characteristics including a relatively low vapor pressure as compared to prior art emission materials.

What is claimed is:

1. In combination with a high-intensity vapor discharge lamp comprising a radiation transmitting arc tube having electrodes operatively supported therein proximate the ends thereof and adapted to have an elongated arc discharge maintained therebetween, and means for connecting said electrodes to an energizing power source; the improved emission material dispersed in said electrodes, said improved electron emission material comprising a reacted mixture of barium zirconate ($BaZrO_3$) plus strontium zirconate ($SrZrO_3$) in a ratio of from 9:1 to 1:1.

2. The combination as specified in claim 1, wherein the emission material comprises a reacted mixture of barium zirconate ($BaZrO_3$) and strontium zirconate ($SrZrO_3$) in a ratio of 4:1.

3. The combination as specified in claim 1, wherein said high intensity discharge lamp is a high pressure sodium-mercury vapor lamp having a polycrystalline alumina arc tube.

4. The combination as specified in claim 1, wherein said high-intensity discharge lamp is a high intensity mercury-vapor discharge lamp having a quartz arc tube.

5. In combination with a high intensity vapor discharge lamp comprising a radiation transmitting arc tube having electrodes operatively supported therein proximate the ends thereof and adapted to have an elongated arc discharge maintained therebetween, and means for connecting said electrodes to an energizing power source, the improved structure for said electrodes each of which comprises:

an elongated refractory metal member having one end portion thereof supported proximate an end of said arc tube and the other end portion of said metal member projecting a short distance inwardly within said arc tube, and overfitting refractory metal coil means carried on the inwardly projecting portion of said elongated metal member; and an electron emissive material carried intermediate turns of said overfitting coil means, said electron emissive material comprising a reacted mixture of barium zirconate ($BaZrO_3$) and strontium zirconate ($SrZrO_3$) in a ratio of from between 9:1 and 1:1.

6. The combination as specified in claim 5, wherein the emission material comprises a reacted mixture of barium zirconate ($BaZrO_3$) and strontium zirconate ($SrZrO_3$) in a ratio of 4:1.

7. The combination as specified in claim 5, wherein said high intensity discharge lamp is a high pressure sodium-mercury vapor lamp having a polycrystalline alumina arc tube.

8. The combination as specified in claim 5, wherein said high-intensity discharge lamp is a high intensity mercury-vapor discharge lamp having a quartz arc tube.

* * * * *